United States Patent [19]

Mendenhall

[11] Patent Number: 4,807,503

[45] Date of Patent: Feb. 28, 1989

[54] HYDRAULIC FOOD CONVERGENCE CUTTER APPARATUS AND METHOD

[76] Inventor: George A. Mendenhall, 4252 S. Eagleson Rd., Boise, Id. 83705

[21] Appl. No.: 151,560

[22] Filed: Feb. 2, 1988

[51] Int. Cl.[4] ..... B26D 1/03

[52] U.S. Cl. ..... 83/22; 83/24; 83/98; 83/112; 83/402; 83/425.2; 83/858; 99/537

[58] Field of Search ..... 83/22, 24, 98, 402, 83/112, 149, 164, 425.2, 856, 858; 99/537, 516; 426/518

[56] References Cited

U.S. PATENT DOCUMENTS

| | | | |
|---|---|---|---|
| 3,109,468 | 11/1953 | Lamb et al. | 83/98 X |
| 3,361,173 | 1/1968 | Lamb | 83/98 X |
| 4,082,024 | 4/1978 | Hodges et al. | 83/402 |
| 4,372,184 | 2/1983 | Fisher et al. | 83/98 |
| 4,423,652 | 1/1984 | Winslow | 83/24 |

*Primary Examiner*—Frank T. Yost
*Assistant Examiner*—Eugenia A. Jones
*Attorney, Agent, or Firm*—Frank J. Dykas

[57] ABSTRACT

In a hydraulic food cutting apparatus having mixing tank 13, food pump 14, converging tube segment 11 for accelerating and aligning food product to be cut, deceleration loop 18 and separating means 20 a method and means for reducing turbulent flow of cut food product 19 and carrier fluid which is either a converging cutter blade assembly 10, having the same angle of convergence and serving as an extension of converging tube segment 11, or in the event a standard in line cutter blade assembly 21 is used, then a second converging tube segment 22 attached to the discharge of the in line cutter blade assembly 21 for reaccelerating the carrier fluid and cut food product 19 as it exits the cutter blade assembly 21, in order to induce improved laminar flow of the carrier fluid and to reduce tumbling of the cut food product 19.

7 Claims, 5 Drawing Sheets

HYDRAULIC FOOD CONVERGENCE CUTTER APPARATUS AND METHODcBACKGROUND OF THE INVENTION

1. Technical Field

This invention relates to the cutting of food product with hydraulic food cutting apparatus. In particular, it relates to a new and improved apparatus and method for inducing improved laminar flow in the cutter blade assembly and thereby obtaining higher quality cut food product from hydraulic food cutting apparatus.

2. Background Art

Typical hydraulic food cutting apparatus in use today have a receiving tank filled with a hydraulic carrier fluid, usually water, into which food product is dumped. A food pump, usually a single impeller centrifugal pump, draws its suction from the receiving tank, and pumps carrier fluid and the suspended food product from the tank into an accelerating tube, which is of converging conical shape similar to the converging segment of a venturi. The accelerating tube aligns and accelerates the food product within the hydraulic carrier fluid for impingement upon a cutter blade assembly. The momentum of the food product acquired in the acceleration process carries the food product through the cutter blade assembly even though a substantial deceleration of the food product occurs in the cutter blade assembly because of the shearing and frictional forces imparted to the food product being cut. The force of the incoming hydraulic carrier fluid helps push the food product through the cutter blade assembly.

The resulting cut food product is then introduced into a deceleration loop which is typically a diverging tube, similar to the diverging segment of a venturi, which has a segment oriented vertically and returns to a point above the receiving tank. Here the hydraulic carrier fluid and cut food product are separated when deposited onto a chain separator. The carrier fluid passes through the chain separator and returns to the receiving tank. The chain separator is typically an endless loop chain and it, or a vibrating screen shaker, is used to mechanically remove the cut food product from the hydraulic cutting apparatus.

The basic principle of operation is one of momentum. The carrier fluid and food product are accelerated to a point where the food product has sufficient momentum to facilitate the shearing or cutting process when the food product impinges upon the cutting blades of the cutter blade assembly. In the current state of the art apparatus, the acceleration of the food product and carrier fluid ceases to be positive at the point where the food product enters the cutter blade assembly. At this point, the food product and hydraulic carrier fluid begin to decelerate at differing rates. This is a result of shearing forces as the food product is being cut, the frictional engagement of the food product with the cutting blades, and the natural deceleration of a carrier fluid in the usually cross-sectionally larger cutter blade assembly. The product of the rapid deceleration of the carrier fluid and food product as they pass through the cutter blade assembly is turbulent flow. This turbulent flow causes the food product to pass through the cutter blade assembly in a non-uniform, non-linear, manner and sometimes results in engagement of the food product with additional cutting surfaces, which are normally configured in staggered relationship, or possibly by engagement with the same cutting surface more than once. This results in a cut food product mixture which includes irregularly shaped pieces and other pieces with multiple or feathered partial cuts. Also, the turbulent flow causes tumbling breakage of cut food product.

Winslow, U.S. Pat. No. 4,423,652, discloses a hydraulic food cutting apparatus which is typical of those in use today. As can be seen, an acceleration tube is used to align and accelerate the food product before it enters the cutter blade assembly. However, from the point where the food product enters the cutter blade assembly, no further attempt is made to minimize turbulent flow. In fact, just the opposite is inadvertantly done by incorporating a divergent conical shape into the cutter blade assembly, which is usually immediately followed by a deceleration tube.

The present solution is not to limit turbulent flow, but rather to limit the use of hydraulic food cutting apparatus to thick, and, rather simple shapes. By doing so, the large, simple shaped, masses of food product can pass through the cutter blade assembly virtually unaffected by the turbulence because of their relatively large inertia.

Increasing the velocity of the carrier fluid and food product so to increase the momentum of the food product and thereby allowing more complicated and less massive food product cuts is also an unacceptable solution. There is an upper limit to the velocity of a hydraulic carrier fluid, called the critical velocity. If the critical velocity is exceeded, the fluid flow will become turbulent and result in undesirable cuts. An estimation of the critical velocity is obtained from the standard Reynolds number equation, $v=pD/nN_R$ where $N_R=2000$, is the Reynolds number, p is the fluid density, v is the average fluid velocity, D is the diameter of the tube, and n is the viscosity of the fluid. To sustain a laminar flow the Reynolds number, $N_R$, must be less than or equal to 2000. If the critical velocity is exceeded in the acceleration tube, turbulent flow will result and cause erratic cuts as the food product passes through the cutter blade assembly.

Present day hydraulic cutting systems eliminate turbulent flow in the acceleration tube by operating at carrier fluid velocities less than the critical velocity. However, they are still plagued with turbulent flow directly within and behind the cutter blade assembly. This turbulent flow is caused, as previously stated, by the rapid deceleration of food product and carrier fluid due to the shear and frictional forces on the food product and geometry of the cutter blade assembly.

What is needed is a method for accelerating, or at least maintaining the velocity of, the food product and carrier fluid as they pass through the cutter blade assembly. By accelerating the fluid through the cutting assembly, the radially inward component of force due to acceleration of carrier fluid in a convergence tube tends to hold the cut food product pieces together and the enhanced laminar flow reduces cut food product tumbling within and immediately upon exiting the cutter blade assembly.

The laminar flow, induced by accelerating the carrier fluid as the food product passes through the cutter blade assembly, would provide an ideal environment for the cutting of food product into thin and fairly complex shapes. In a laminar flow, the average fluid velocity need only be high enough to provide sufficient momentum to facilitate the actual cutting process.

Accordingly, it is the object of this invention to provide an apparatus and method for producing improved food cuts by inducing better laminar flow in and around the cutter blade assembly.

DISCLOSURE OF INVENTION

This object is accomplished by using one of two similar apparatus both of which embody the same principles.

The first embodiment is a convergence cutter assembly which has a converging, conically shaped housing which conforms to the convergent angles of the acceleration tube and serves, from a fluid flow standpoint, as an extension thereof. Food product is deposited in a carrier fluid in a mixing tank. The mixture of food product and carrier fluid is then pumped into the acceleration tube where it is accelerated and the food product aligned and separated one from the other. Substantially laminar flow of the carrier fluid is established in the acceleration tube.

The result of the convergence cutter housing serving as a functional extension of the acceleration tube is that improved laminar flow is maintained through the cutter blade assembly. Because of this, the cut pieces of food product tend to hold together in the same general shape of the original food product rather than to individually tumble and possibly impinge upon a second cutter blade or each other.

The same beneficial effect is derived from the second embodiment which utilizes a standard, uniform cross-sectional, cutter blade housing. In the second embodiment, enhanced laminar flow is maintained within the cutter blade housing by use of a second convergence tube at the discharge of the cutter blade housing to immediately reaccelerate the cut food pieces and carrier fluid exiting the cutter blade assembly. This again results in the cut food product pieces holding together rather than tumbling.

In both embodiments, after the cut food product has been safely carried away from the cutter blade housing, it is decelerated in a diverging tube and loop before being deposited into a separator which separates the cut food product from the carrier fluid which is then returned to the holding tank.

BEST MODE FOR CARRYING OUT INVENTION

Figure 1:
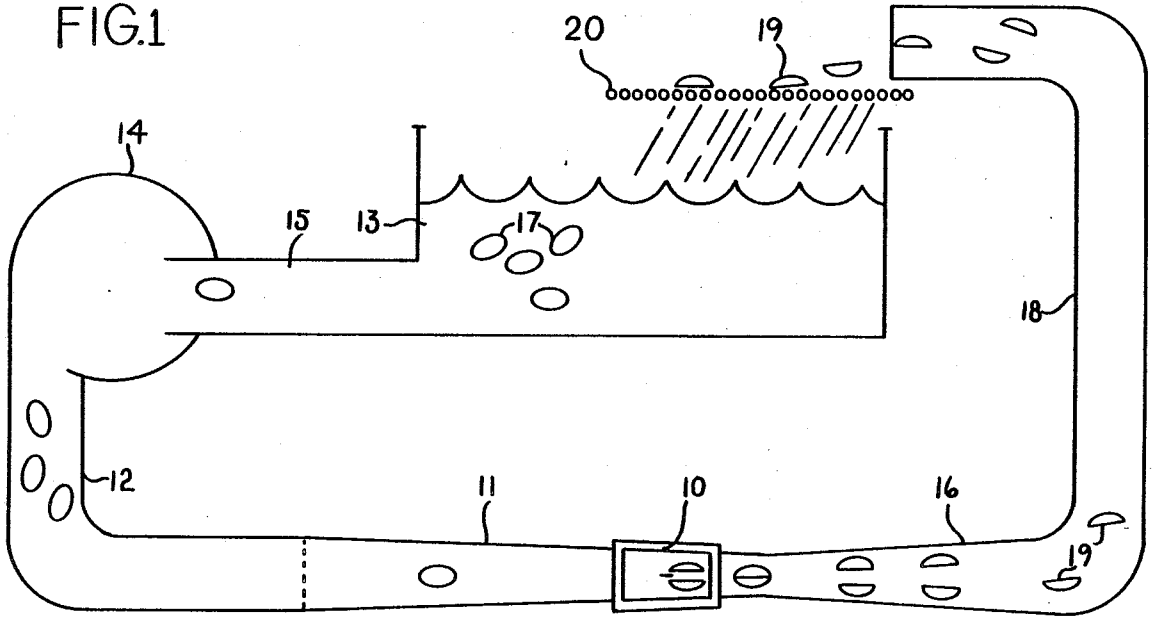
FIG. 1 is a schematical representational of a hydraulic cutting apparatus using a convergence cutter.

FIG. 1 representationally discloses the features of a hydraulic food convergence cutting apparatus. Food product 17 is dumped into tank 13, which is filled with hydraulic carrier fluid, typically water. Pump suction 15 draws a mixture of suspended food product 17 and carrier fluid into centrifugal pump 14 where it is accelerated into pump discharge tube 12. Typically centrifugal pump 14 is a single impeller centrifugal food pump of a kind commonly available today. The food pump accelerates the suspended food product and hydraulic carrier fluid to velocities of 40 to 60 feet per second.

The accelerated mixture of food product 17 and hydraulic carrier fluid enters converging tube segment 11 where a venturi type effect occurs with the hydraulic carrier fluid and the suspended food product 17 undergoing further velocity acceleration. Additionally, food product 17 becomes uniformly aligned, primarily as a result of the increasing laminar flow of the hydraulic carrier fluid experienced as it increases velocity in converging tube segment 11.

Figure 2:
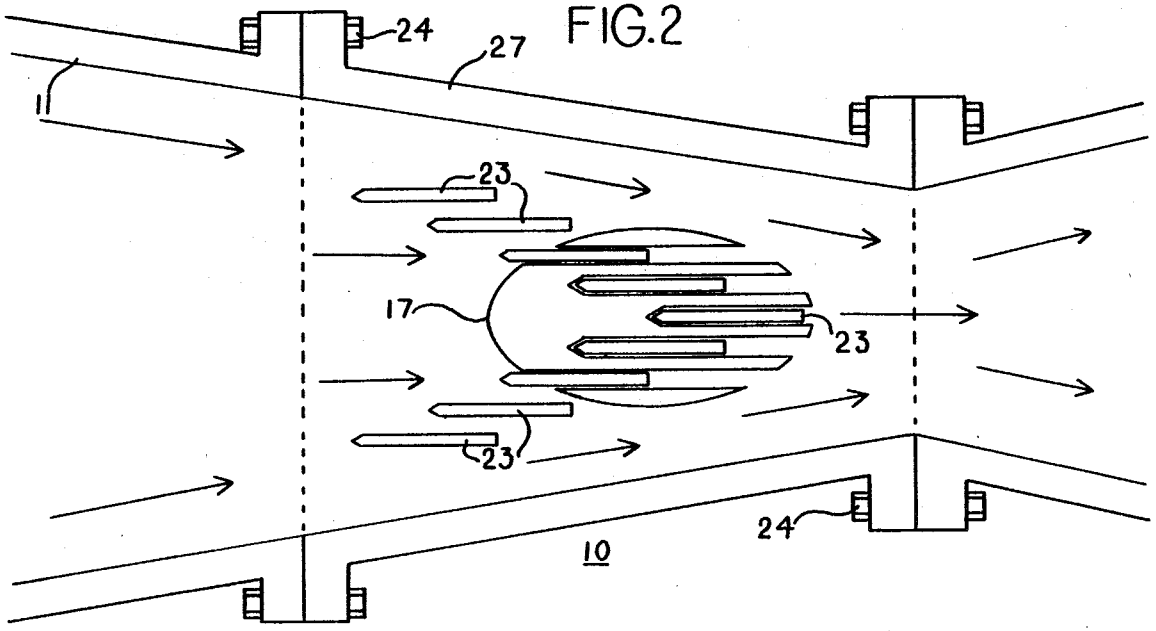
FIG. 2 is a schematical representation of a convergence cutter assembly cutting a food product.
Figure 3:
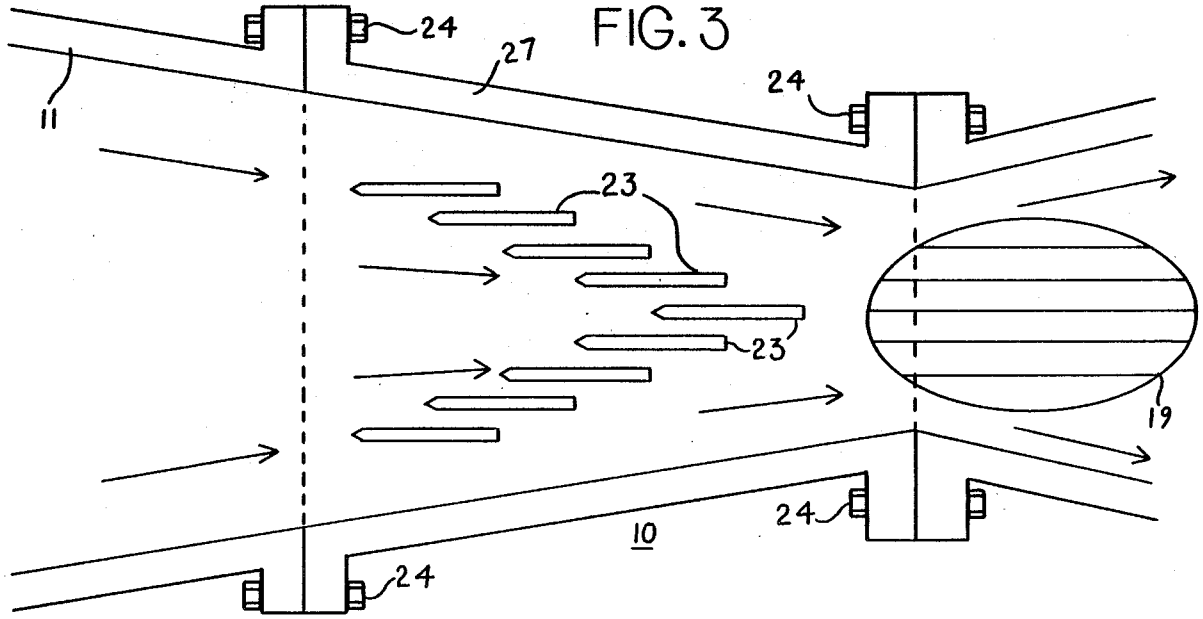
FIG. 3 is a schematical representation of cut food product exiting a convergence cutter.

Referring to FIGS. 1, 2 and 3, my new converging cutter assembly 10 is shown to advantage in representational format. Cutter assembly 10 is comprised of a converging housing 27 which conforms to the convergent angles of converging tube segment 11 and functions as an extension thereof.

Slab cutter blades 23 are disposed within convergence housing 27 to present a parallel horizontal array of cutting edges to the oncoming food product 17. Horizontal cutter blades 23 are held in place or otherwise mounted in convergence housing 27 in a variety of different methods, all of which are well known in the art. Most commonly, cutter blades 23 have extensions inserted into notches or slots in convergence housing 27. These conventional mounting methods are not shown.

When food product 17 impacts upon the cutting edges of the cutter blade array a number of mechanical forces are introduced as the food product is being sheared into a plurality of separate pieces. These forces include dynamically induced resistance of food product 17 to the shearing effect of cutter blades 23 and frictional forces between the food product 17 and cutter blades 23. The result is a rapid deceleration of food product 17 relative to the hydraulic carrier fluid which substantially increases the tendency of the hydraulic carrier fluid to revert from laminar flow to turbulent flow. This tendency to revert from laminar flow to turbulent flow is minimized by the fact that the cutting process takes place within convergence housing 27.

The cut food product 19 then passes into diverging tube segment 16 where deceleration of the food product and hydraulic carrier fluid is initiated. It is then usually pumped upward through deceleration loop 18, and subsequently dumped onto separator chain 20 where water or whatever hydraulic carrier fluid is being used drains back to tank 13 and the cut food product 19 is carried off for further processing.

The beneficial effect of increased laminar flow of the hydraulic carrier fluid within convergence cutter 10 is that it tends to hold the cut pieces of food product 19 together in approximately the same configuration as the original uncut food product 17 thereby minimizing tumbling of the various pieces which can result in inadvertent impingement against a second cutter blade in the array or breakage caused by turbulent impact with other cut pieces or the walls of the cutter assembly.

In practice it has been found that by using my new convergence cutter 10, I am able to cut more intricate cuts of food products and even cut slabs of potatoes just a few millimeters thick which are actually suitable for processing into potato chips.

Figure 4:
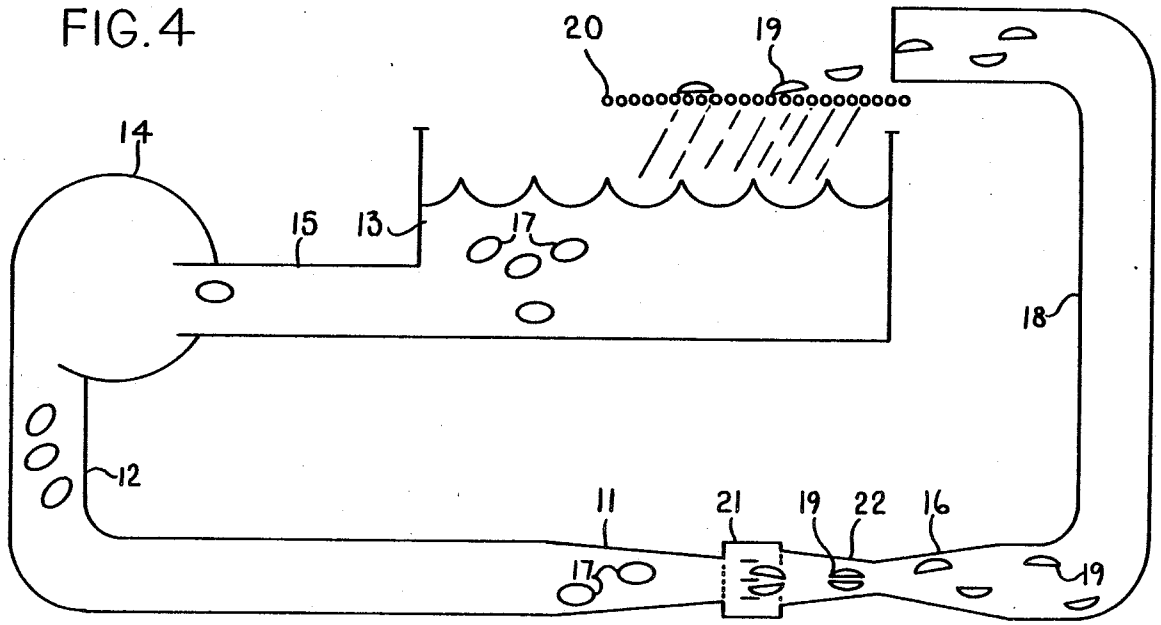
FIG. 4 is a schematical representation of a hydraulic cutting apparatus utilizing a second convergence tube.
Figure 5:
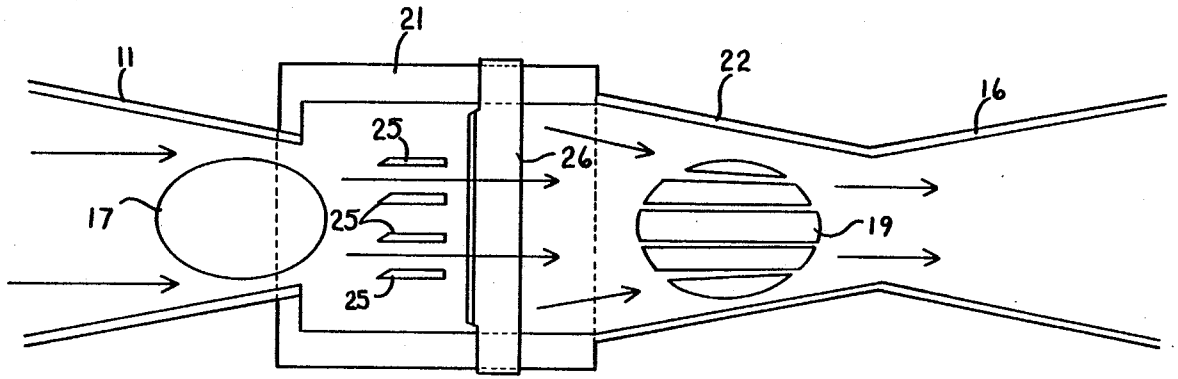
FIG. 5 is a schematical representation of a cutter blade assembly and second convergence tube assembly with uncut food product entering the cutter blade assembly and cut food product entering the second convergence tube.

Referring to FIGS. 4 and 5 a second embodiment of the principles of my invention is disclosed. In this second embodiment, second convergence tube 22 is positioned immediately behind the in line cutter blade assembly 21 to immediately reaccelerate the hydraulic carrier fluid and cut food product 19 upon its exiting cutter blade assembly 21. This adaptation of my invention is particularly useful as a retrofitting device for currently existing hydraulic cutter apparatus, and in practice has been found to actually draw a partial vacuum at the exit of the cutter blade assembly housing and to produce results comparable to those of my convergence cutter 10.

As can be seen in FIG. 5, in line cutter blade assembly 21 has a plurality of horizontally arrayed cutter blades 25 which are immediately followed by vertically oriented and arrayed cutter blades 26. With this cutter blade configuration a food product such as potatoes can be cut into strips of french fries.

Again referring to FIG. 5, food product 17 is shown entering into the in line cutter blade assembly 21 where it will first impinge upon horizontally arrayed cutter blades 25 and then impinge upon vertically arrayed cutter blades 26. The laminar flow of the hydraulic carrier fluid in convergence tube segment 11 is disrupted within in line cutter blade assembly 21 and would result in substantial and severe turbulent flow of the hydraulic carrier fluid and the cut food product 19 as they exit cutter blade assembly 21.

However, by the installation of second convergence tube 22 immediately at the discharge point from in line cutter blade assembly 21, the hydraluic carrier fluid and the cut food product 19 immediately begin to reaccelerate and compress back in laminar flow fashion. This minimizes the turbulent flow and prevents cut food product 19 from tumbling, impacting with other pieces of cut food product, or the walls of the hydraulic cutting apparatus until after it has reached diverging tube segment 16 which initiates the deceleration process in a cross-sectional area where tumbling and associated impacts with other food product and the walls will be minimized.

For the sake of clarity in this detailed description of preferred embodiments, I have referred to the converging tube segments as tubes or other round passages. It should be apparent to anyone skilled in the art that the principles of this invention may easily and readily be adapted for use in rectangular converging and diverging passages as may be the case in some alternative designs for hydraulic cutting apparatus.

While there is shown and described the present preferred embodiment of the invention, it is to be distinctly understood that this invention is not limited thereto but may be variously embodied to practice within the scope of the following claims.

What is claimed is:

1. A method for cutting food product using a hydraulic fluid cutting apparatus which comprises:

depositing the food product in a hydraulic carrier fluid;

pumping the food product and hydraulic carrier fluid mixture into a first converging conical segment of tubing for accelerating and aligning the food product to be cut in a laminar flow of hydraulic carrier fluid;

cutting the food product by passing the food product and the hydraulic carrier fluid through a cutter blade assembly having the same converging angles as and serving as an extension of, the converging conical segment and converging axially inward from its inlet end to its outlet end;

decelerating the cut food product and hydraulic carrier fluid by passing it through a diverging conical segment of tubing;

separating the cut food product from the hydraulic carrier fluid.

2. A method for cutting food product using a hydraulic fluid cutting apparatus which comprises:

depositing the food product in a hydraulic carrier fluid;

pumping the food product and hydraulic fluid mixture into a first converging conical segment of tubing for accelerating and aligning the food product to be cut in a laminar flow of hydraulic carrier fluid;

cutting the food product by passing the food product and the hydraulic carrier fluid through a cutter blade assembly;

maintaining improved laminar flow of the hydraulic carrier fluid through the cutter blade assembly by reaccelerating the hydraulic carrier fluid and cut food product exiting the cutter blade assembly by passing them through a second converging conical segment of tubing which converges axially inward toward its outlet;

decelerating the cut food product and hydraulic carrier fluid by passing them through a diverging conical segment of tubing;

separating the cut food product from the hydraulic carrier.

3. An apparatus for cutting food product which comprises:

mean for mixing food product with a hydraulic carrier fluid operatively connected to a pumping means;

a converging tube segment for accelerating and aligning food product in a laminar flow of carrier fluid;

means for pumping the food product and carrier fluid mixture from the mixing means to the converging tube segment, operatively connected to the mixing means and the converging tube segment;

a convergent cutter blade assembly for receiving and cutting food product, having an inlet and an outlet, and having the same convergent angles as the convergent tube segment, axially aligned with and serving as an extension of the convergent tube segment, operatively connected at its inlet to the convergent end of the convergent tube segment, said convergent cutter blade assembly converging axially inward from its inlet end to its outlet end;

means for decelerating the cut food product and carrier fluid mixture operatively connected to the outlet of the convergent cutter blade assembly;

means for separating the cut food product from the carrier fluid operatively connected to the deceleration means.

4. An apparatus for cutting food product which comprises:

means for mixing food product with a hydraulic carrier fluid operatively connected to a pumping means;

a first converging tube segment for accelerating and aligning food product in a laminar flow of carrier fluid;

means for pumping the food product and carrier fluid mixture from the mixing means to the first converging tube segment, operatively connected to the mixing means and the converging tube segment;

a cutter blade assembly for receiving and cutting food product, having an inlet, and an outlet, axially aligned with, and operatively connected at its inlet to the convergent end of the first converging tube segment;

convergent means for reducing turbulent flow of carrier fluid in the cutter blade assembly, said convergent means converging axially inward from its inlet to its outlet;

means for decelerating the cut food product and carrier fluid mixture operatively connected to the outlet of the means for reducing turbulent flow;

means for separating the cut food product from the carrier fluid operatively connected to the deceleration means.

5. The apparatus of claim 4 wherein the means for reducing turbulent flow of carrier fluid in the cutter blade assembly further comprises:

means for inducing laminar flow of the carrier fluid at the outlet of the cutter blade assembly operatively connected to the outlet of the cutter blade assembly.

6. The apparatus of claim 5 wherein the means for inducing laminar flow further comprises:

a second convergent tube segment for receiving and reaccelerating a mixture of cut food pieces and carrier fluid operatively connected to the outlet of the cutter blade assembly, said convergent tube converging from its inlet end to its outlet end.

7. The apparatus of claim 6 wherein the crosssectional area of the outlet end of the second convergent tube segment is smaller than the cross-sectional area of the outlet end of the first convergent tube.

* * * * *